United States Patent [19]

Otala

[11] Patent Number: 4,750,590

[45] Date of Patent: Jun. 14, 1988

[54] COUNTERACTING ELEVATOR CAR OSCILLATION

[75] Inventor: Matti Otala, Helsinki, Finland

[73] Assignee: Kone Elevator GmbH, Baar, Switzerland

[21] Appl. No.: 909,723

[22] Filed: Sep. 22, 1986

[30] Foreign Application Priority Data

Sep. 27, 1985 [FI] Finland ..... 853732

[51] Int. Cl.[4] ..... B66B 7/02

[52] U.S. Cl. ..... 187/95; 318/568; 364/174

[58] Field of Search ..... 187/1 R, 17, 95, 28; 318/567, 568, 576, 580; 364/174; 73/849, 505; 104/127, 128

[56] References Cited

U.S. PATENT DOCUMENTS 4,507,738 3/1985 Nozawa et al. ..... 318/568

4,617,502 10/1986 Sakaue et al. ..... 318/568

*Primary Examiner*—H. Grant Skaggs

*Assistant Examiner*—Kenneth Noland

*Attorney, Agent, or Firm*—Sughrue, Mion, Zinn, Macpeak and Seas

[57] ABSTRACT

A method of and apparatus for continuously counteracting lateral oscillation of an elevator car provided with guide shoes running along guide rails by laterally displacing the guide shoes in accordance with the out-of-straightness of the guide rails by ascertaining the magnitudes of local deviations of the guide rails from a straight condition thereof and setting up in the memory of a computer controlling the guide shoes a deviation table relating the local deviations to the position of the car along the path of travel, and subsequently controlling the guide shoes by the computer in dependence on the table to displace the elevator car laterally to compensate for the local deviation at any position of the elevator car at which the local deviations occur.

8 Claims, 1 Drawing Sheet

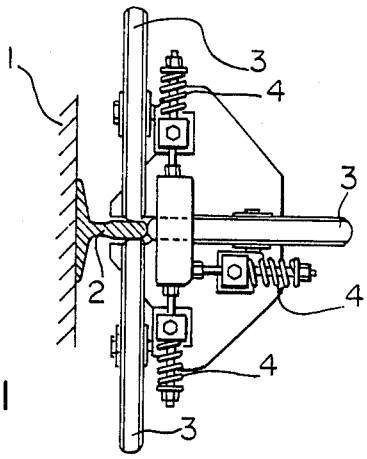
PRIOR ART FIG. 1
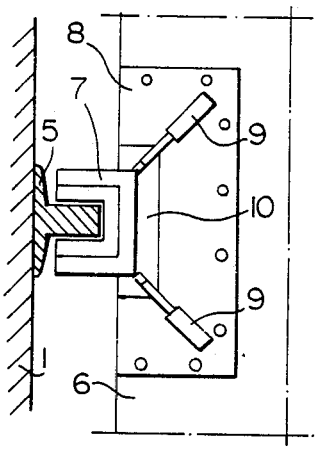
FIG. 2a
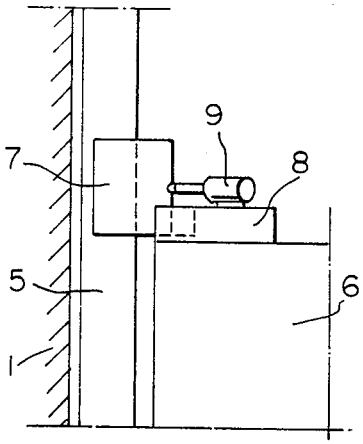
FIG. 2b
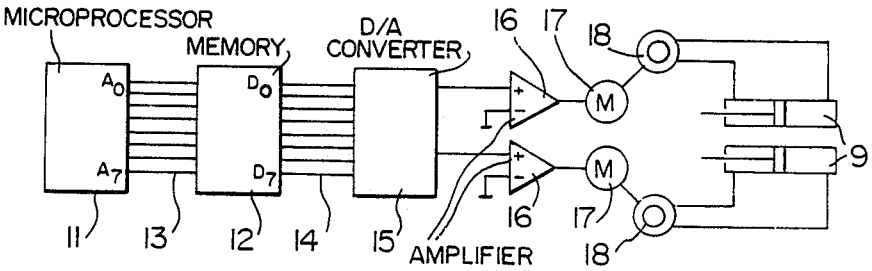
FIG. 3

COUNTERACTING ELEVATOR CAR OSCILLATION

FIELD OF THE INVENTION

The present invention concerns a procedure and a means for continuous compensation of an elevator car's lateral oscillation, wherein guide shoes of the elevator car are moved in accordance with the out-of-straightness of the elevator's guide rails.

DESCRIPTION OF THE PRIOR ART

Two guide rails are normally provided in an elevator well, consisting of rails along which the elevator car travels and which invariably are more or less out of straight. This is due not only to the fact that it is impossible to produce long and perfectly straight guide rails but also to the settling of buildings, particularly new ones. Deviations of the guide rail line give rise to transverse swaying and vibration of the elevator car, and this is highly uncomfortable, particularly in high speed elevators.

The long guide rails, in particular, in skyscrapers, which almost without exception involve high speed elevators have to be straightened about every two years. This is an exceedingly expensive operation, during which the elevator is out of service while the respective well is being serviced. As a result, the capacity of a bank of elevators which often would otherwise be carrying heavy loads, is reduced by at least the transporting capacity of one elevator until all the guide rails in this bank have been straightened.

Through the U.S. Pat. No. 3,669,222 are known elevator guide wheels which are passively damped in a conventional manner, and by the aid of which lateral impacts transmitted to the elevator car from the guide rails can be damped. This design, although probably usable, fails to eliminate oscillation of the elevator car, the oscillation being merely damped to some degree. The prior art also includes suggestions for actively compensating the lateral oscillation of the elevator which proposals mostly have not gone beyond the experimental stage and in which an attempt is made to correct the path of the elevator relative to the guide rails on the basis of the elevator's momentary lateral acceleration. In most cases, the outcome has been fully the opposite to that required, from the passengers'point of view: i.e. the elevator has oscillated more strongly with compensation switched on than without it.

It is obvious that it is not feasible, or sensible, within existing technology to construct a feedback-type system for controlling the movements of an elevator car which is based on real-time observations and responses thereto. The changes are too rapid and abrupt, and the masses to be moved are too great.

BRIEF SUMMARY OF THE INVENTION

It is accordingly an object of the present invention to provide a method of and an apparatus for counteracting lateral oscillation of an elevator car with the aid of which intervals between straightened guide rails can be remarkably increased, at least doubled, and in the most favorable cases, such straightening may be rendered superfluous.

According to the invention there is provided a method of continuously counteracting lateral oscillation of an elevator car provided with guide shoes running along guide rails by laterally displacing the guide shoes in accordance with the out-of-straightness of the guide rails, comprising the steps of, ascertaining the magnitudes of local deviations of the guide rails from a straight condition thereof and setting up in the memory of a computer controlling the guide shoes a deviation table relating the local deviations to the position of the car along the path of travel, and subsequently controlling the guide shoes by the computer in dependence on the table to displace the elevator car laterally to compensate for the local deviation at any position of the elevator car at which the local deviations occur.

As taught by the principles of the invention, the fact has been accepted that functioning real time control of the evelator car's guide shoes can hardly ever be accomplished. Instead, guide shoe operating means are taught an action model which is always followed until it is found that the rails have been so much displaced that a new action model must be taught to the operating means. By making routine checks of the guide rails, e.g. in connection with annual overhauls, the elevator can be made to run smoothly at all times and the need to straighten the rails will occur at substantially longer intervals, compared with the present situation. It ma well be that the guide rails in the elevator well will always remain within the range of movement of the guide shoes, whereby there will be no need for straightening.

The method according to the invention may include temporarily attaching acceleration meters to the elevator car and performing an uncorrected trial run with the elevator, the deviation value table being derived from information obtained from the acceleration meters.

The setting up of the deviation value table is most conveniently automatically accomplished with a computer, by calculating with a given algorithm the deviations of the guide rails from the results of the measurements, by transforming the obtained values into a form intelligible to the computer controlling the guide shoes and by storing these values in the semiconductor working memory of the computer to constitute the elements of the deviation value table. The interpretation of the results of measurements can be carried out by the above-mentioned computer dedicated to the guide shoes, by the elevator control computer, or by a separate processor constituting part of the measuring apparatus.

The invention further provides apparatus for continuously counteracting lateral oscillation of an elevator, comprising, guide shoes engageable with guide rails for guiding travel of the car along the guide rails, operating means controllable to operate the guide shoes to displace the car laterally relative to the guide rails, a control system for controlling the operation of the operating means, the control system comprising at least one measuring means for detecting out-of-straightness of the guide rails and computer means for operating the operating means to positively control the guide shoes during normal travel of the car in conformity with a running instruction for the guide shoes precalculated in the computer means.

BRIEF DESCRIPTION OF THE DRAWINGS

An embodiment of the invention is described in the following with reference to the accompanying drawing, wherein:

FIG. 1 presents a design representing the state of the art;

FIGS. 2*a* and 2*b* present the mechanical implementation of a design embodying the present invention, in top view and in elevational view; and FIG. 3 presents the circuit diagram of the control logics of the embodiment of FIGS. 2*a* and 2*b*.

DETAILED DESCRIPTION OF THE DRAWINGS

In the prior art apparatus depicted in FIG. 1, three wheels 3, mounted on a carriage and guiding the travel of an elevator, have been disposed to run along a guide rail 2 affixed to a wall 1 of the elevator well, each wheel having its own spring suspension means 4. The apparatus is quite complicated and requires maintenance. Moreover, impacts from the guide rails acting on the elevator car can only be damped, and cannot be completely eliminated.

In FIG. 2*a* there is depicted the mechanical implementation of a design embodying the invention, in top view. On the well wall 1 is mounted a guide rail 5 of an elevator car 6, along which a guide shoe 7 travels. The guide shoe 7 is mounted on a base or carriage 8 in such manner that the guide shoe 7 can be moved in the plane of FIG. 2*a* by means of hydraulic cylinders 9 in relation to the elevator car 6. The intervening space 10 constitutes the maximum range of movement of the guide shoe 7. FIG. 2*b* shows the same means in elevational view. The guide shoe 7 is one of a plurality of such guide shoes.

FIG. 3 depicts, in a block diagram, a logic system for controlling the guide shoe. The nucleus of the system is a microprocessor 11, mounted in the elevator car in conjunction with the guide shoes, and a routine permanently programmed in this microprocessor constantly addressing (READ command), for instance, an EPROM-type memory 12 via an address bus 13. The memory circuit sets the contents of the memory position addressed at each moment, e.g. on an eight-bit data bus 14, the value of this byte being converted into an analog voltage by a D/A converter 15 and said voltage being amplified by amplifiers 16. The amplified voltage serves as loading value for motors 17 of the hydraulic system, these motors controlling hydraulic pumps 18 which in turn operate the hydraulic cylinders 9 controlling the guide shoe 7 of the elevator car.

Other ways of implementing the control will be readily apparent to those skilled in the art: in the example presented above, endeavors have been made to incorporate the date required for the control in the memory circuit 12 as completely as possible, whereby the requisite circuits will be simple. The simultaneous but different loading voltages required for the two operational amplifiers 16 can be contemplated as being separately tabulated and transmitted separately, in parallel, from the memory circuit 12, but it is also conceivable that the difference is not generated until in connection with the D/A converter, in which case the byte transmitted to the converter indicates the desired absolute location of the guide shoe, the need of change in positioning arising therefrom being separately examined in the case of each hydraulic cylinder 9.

It is obvious to a person skilled in the art that various embodiments of the invention are not restricted to the example presented above and that they may vary within the scope of the claims presented below.

I claim:

1. A method of continuously counteracting lateral oscillation of an elevator car provided with guide shoes running along guide rails by laterally displacing said guide shoes in accordance with the out-of-straightness of said guide rails, comprising the steps of:

ascertaining the magnitudes of local deviations of said guide rails from a straight condition thereof and setting up in the memory of a computer controlling the guide shoes a deviation table relating said local deviations to the position of said elevator car along a path of travel of said elevator car; and subsequently controlling said shoes by said computer in dependence on said table to displace said elevator car laterally to compensate for a local deviation at any position of the path of travel of said elevator car at which said local deviations occur, so that the elevator car travels in a path which is straighter than said guide rails.

2. A method according to claim 1, including temporarily attaching acceleration meters to the elevator car and performing an uncorrected trial run with the elevator, the deviation value table being derived from information obtained from said acceleration meters.

3. A method according to claim 2, including controlling said guide shoes of said car by a separate processor mounted in conjunction with operating means for said guide shoes, said processor having as memory containing the deviation table, and obtaining information on the position of said elevator from a control computer of said elevator.

4. A method according to claim 1, including controlling said guide shoes of said car by a separate processor mounted in conjunction with operating means for said guide shoes, said processor having a memory containing the deviation table and obtaining information on the position of said elevator from a control computer of said elevator.

5. Apparatus for continuously counteracting lateral oscillation of an elevator, comprising:

guide shoe means for engaging guide rails to guide travel of said car along said guide rails;

operating means for adjusting said guide shoe means to displace said car laterally relative to said guide rails;

a control system for controlling the operation of said operating means;

memory means for storing a deviation table relating the magnitudes of local deviations of said guide rail from a straight condition thereof to the position of said elevator car along said guide rails; and means for operating said operating means in accordance with the data in said deviation table.

6. Apparatus according to claim 5, wherein said measuring means comprise at least one acceleration sensor.

7. Apparatus according to claim 6, wherein said operating means of said guide shoes comprise solenoids.

8. Apparatus according to claim 5, wherein said operating means of said guide shoes comprise solenoids.

* * * * *